US008109788B1

(12) United States Patent
Harlan et al.

(10) Patent No.: US 8,109,788 B1
(45) Date of Patent: Feb. 7, 2012

(54) CABLE ASSEMBLY WITH IMPROVED GROUNDING BAR

(75) Inventors: Tod M. Harlan, Mechanicsburg, PA (US); Richard Lee Malehorn, II, York, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/882,621

(22) Filed: Sep. 15, 2010

(51) Int. Cl.
*H01R 9/05* (2006.01)

(52) U.S. Cl. ..... 439/579

(58) Field of Classification Search ..... 439/579
See application file for complete search history.

(56) References Cited

U.S. PATENT DOCUMENTS 6,755,687 B1 6/2004 Ko
2010/0227502 A1* 9/2010 Wu ..... 439/607.05

OTHER PUBLICATIONS

Confidential drawings from colleagues of the same assignee.

* cited by examiner

*Primary Examiner* — Ross Gushi

(74) *Attorney, Agent, or Firm* — Wei Te Chung; Andrew C. Cheng; Ming Chieh Chang

(57) ABSTRACT

A cable assembly includes a housing including a main portion defining a connecting direction and a mating portion defining a mating direction, the connecting direction being perpendicular to the mating direction, a plurality of contacts receiving in the housing, a plurality of cables each including an inner conductor connected to the contacts and an outer conductor, a grounding bar connected to all the outer conductors of the cables. The grounding bar defines a long side extending along a direction perpendicular to the connecting direction and a short side extending along a direction parallel to the mating direction, and the housing further has a receiving trough to receive the grounding bar.

19 Claims, 5 Drawing Sheets

CABLE ASSEMBLY WITH IMPROVED GROUNDING BAR

BACKGROUND OF THE INVENTION

1. Field of the Invention

The present invention relates generally to a cable assembly, and more particularly to a cable assembly used in electric device and having improved grounding bar.

2. Description of the Prior Art

Present cable assembly is needed to own low profile, small size and simple production. A micro coaxial cable assembly always comprises a housing, a plurality of contacts, a plurality of micro coaxial cables connected to the contacts and a grounding bar. U.S. Pat. No. 6,755,687, issued to Ko on Jun. 29, 2004, discloses a micro coaxial cable assembly. The cable assembly comprises a housing, a plurality of contacts, a plurality of micro coaxial cables, a pair of shells and a grounding bar. However, the grounding bar increases the height of the cable assembly and is not suit for low-profile cable assembly.

Hence, in this art, an improved cable assembly to overcome the above-mentioned disadvantages of the prior art should be provided.

BRIEF SUMMARY OF THE INVENTION

A primary object, therefore, of the present invention is to provide a cable assembly with an improved grounding bar.

In order to implement the above object, the cable assembly comprises a housing comprising a main portion defining a connecting direction and a mating portion defining a mating direction, the connecting direction being perpendicular to the mating direction, a plurality of contacts receiving in the housing, a plurality of cables each comprising an inner conductor connected to the contacts and an outer conductor, a grounding bar connected to all the outer conductors of the cables. The grounding bar defines a long side extending along a direction perpendicular to the connecting direction and a short side extending along a direction parallel to the mating direction, and the housing comprises a receiving trough receiving the grounding bar.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
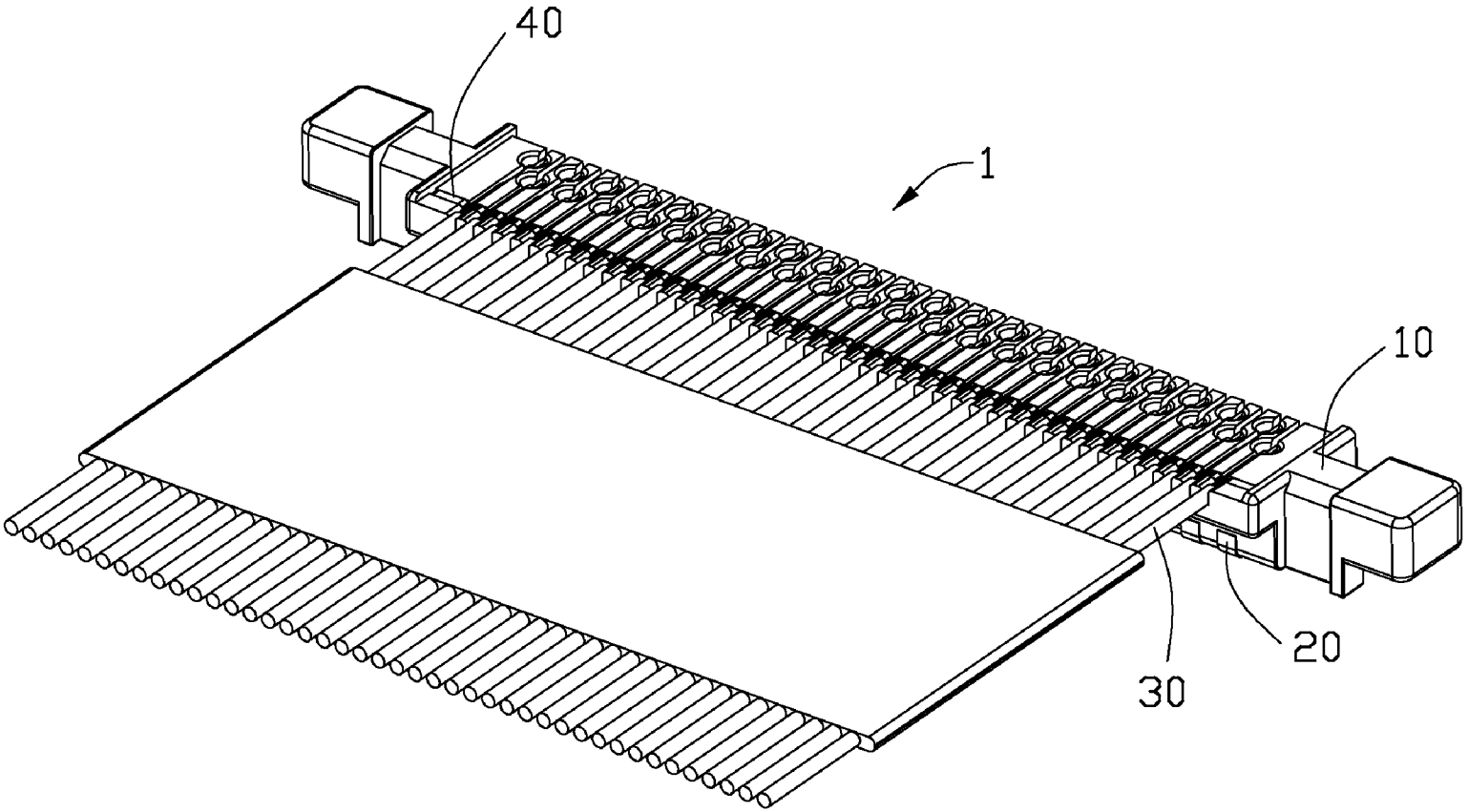
FIG. 1 is a perspective view of a cable assembly in according with the present invention.
Figure 2:
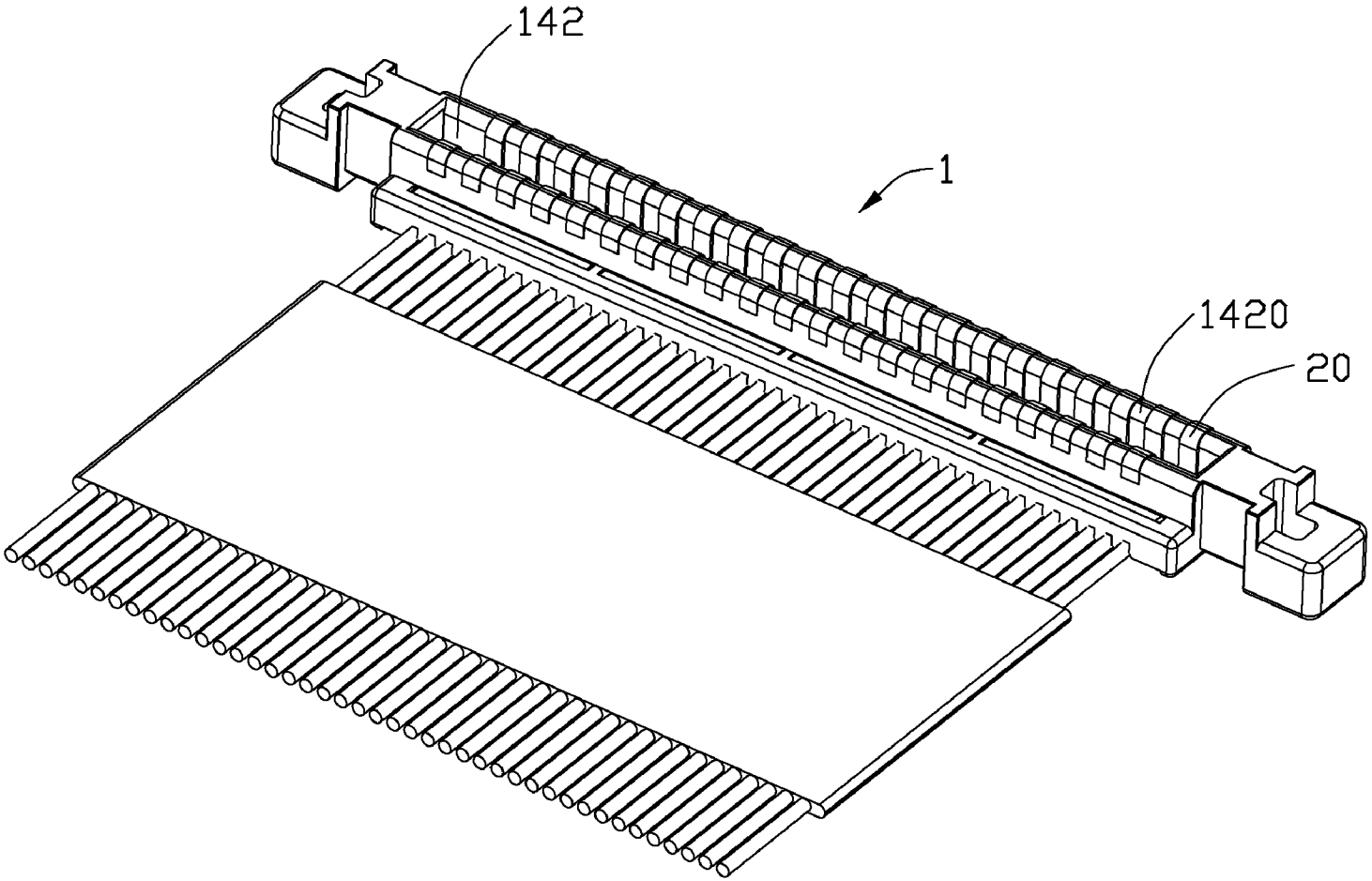
FIG. 2 is a view similar to FIG. 1, but taken from a different aspect.
Figure 3:
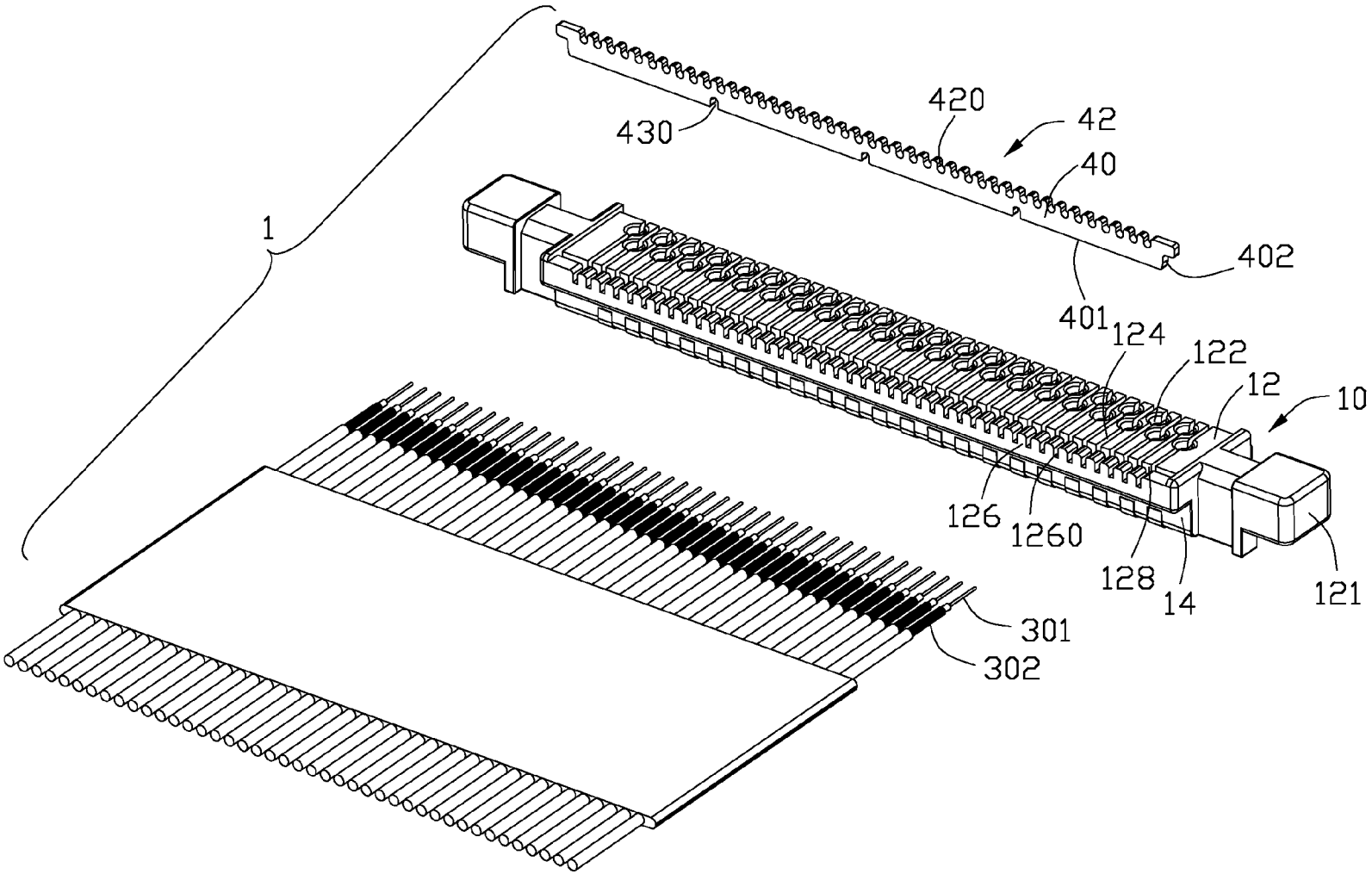
FIG. 3 is an exploded, perspective view of the cable assembly in according with the present invention.
Figure 4:
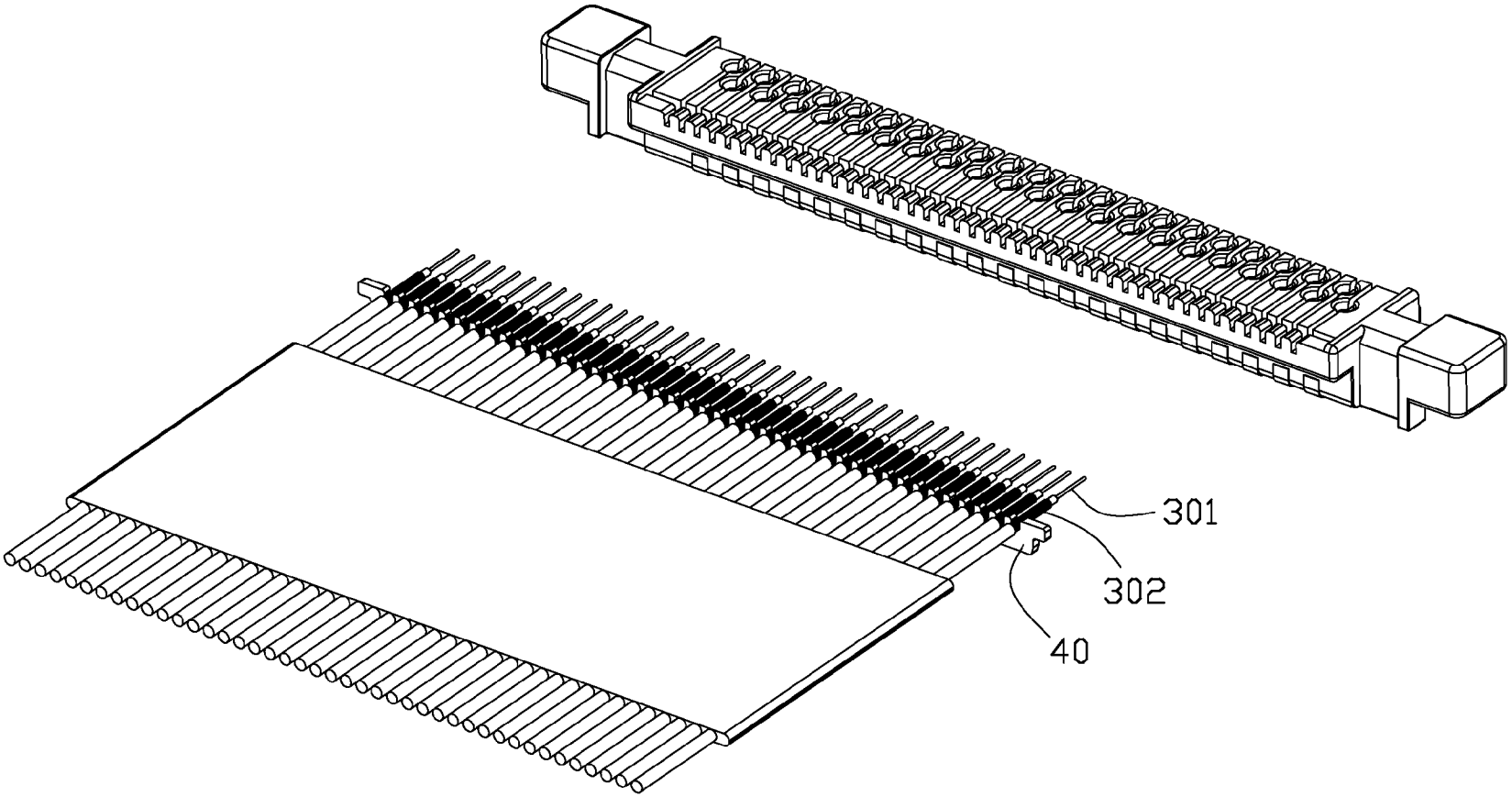
FIG. 4 is a partly assembled perspective view of the cable assembly of the present invention.
Figure 5:
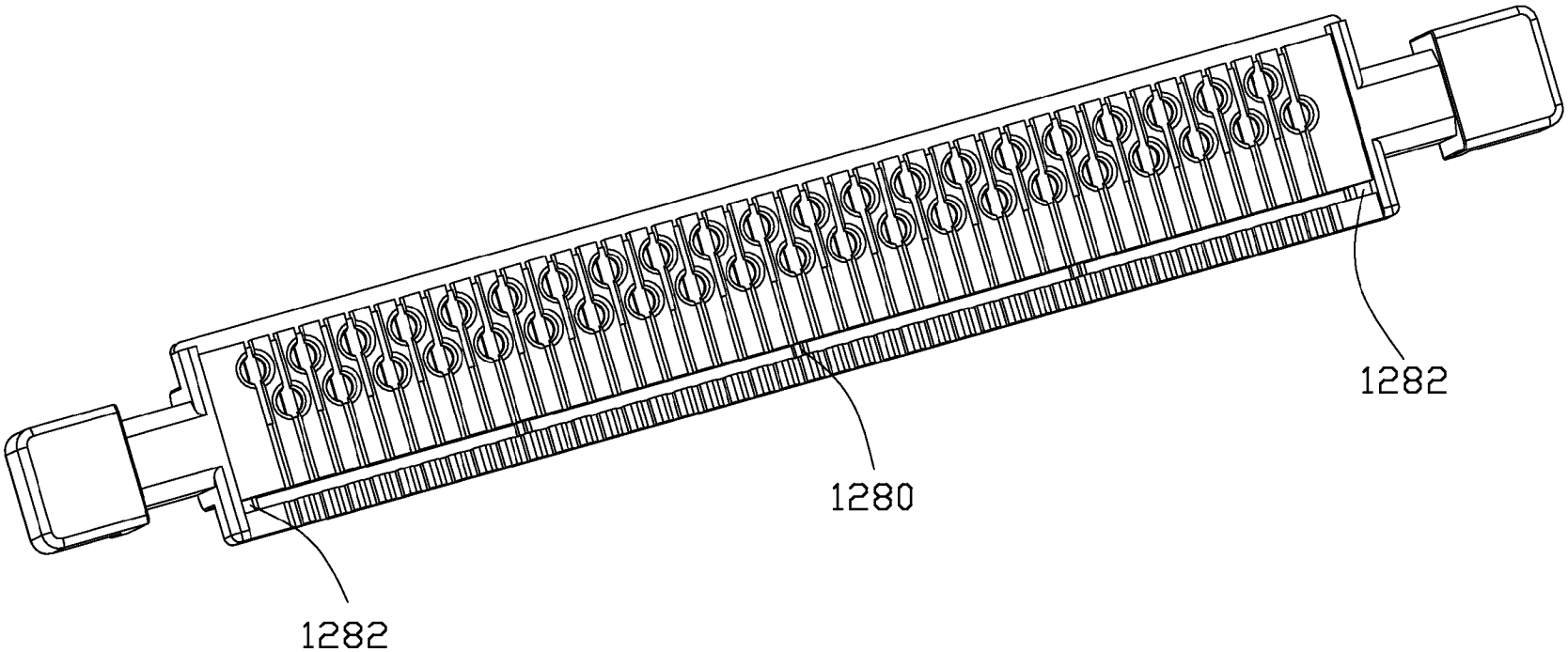
FIG. 5 is a perspective view of a housing of the cable assembly in according with the present invention.

FIGS. 1 to 5 illustrate perspective views of a cable assembly 1 made in accordance with the present invention. The cable assembly 1 comprises a housing 10, a plurality of contacts 20 received in the housing 10, a plurality of cables 30 each comprising an inner conductor 301 and an outer conductor 302, a grounding bar 40 received in the housing 10.

The housing 10 comprises main portion 12, a mating portion 14, and a pair of wing portions 16 connected to the main portion 12 and the mating portion 14. The main portion 12 defines a connecting direction and the cables 30 extend along the connecting direction. The mating portion 14 is mated to a complementary connector along a mating direction perpendicular to the connecting direction. The main portion 12 comprises a plurality of holes 122 for receiving contacts 20, a plurality of receiving slots 124 corresponding to the holes 122, a supporting portion 126 with a plurality of receiving grooves 1260, and a receiving trough 128 located between the receiving slots 124 and the supporting portion 126. The holes 122 are staggered and arranged in two rows, and each the receiving slot 124 respectively passes through its corresponding hole 122. The mating portion 14 comprises a rectangular mating groove 142. The contacts 20 comprises connecting portions received in the holes of the main portion 12 and mating portions arranged on two side walls of the mating groove 142.

The receiving trough 128 defines a longest side extending along a direction perpendicular to the connecting direction and the mating direction, a shortest side extending along the connecting direction and a middle side extending along the mating direction. The receiving trough 128 has a plurality of ribs 1280 located on the bottom thereof and a pair of block 1282 located on the two ends thereof to make the receiving trough 128 be of T-shaped configuration. Each of the two wing portions 16 defines an L-like configuration in a side view.

The grounding bar 40 is of vertical T-shape configuration and defines a long side 401 extending along a direction perpendicular to the connecting direction and a short side 402 extending along a direction parallel to the mating direction. The grounding bar comprises a dentate top portion 42 with a plurality of hollows 420, and a plurality of gaps 430 located on the bottom there of and corresponding to the ribs 1280 of the housing 10. The grounding bar 40 is received in the receiving trough 128 of the housing 10. When the grounding bar 40 is inserted into the receiving trough 128, the ribs 1280 are inserted into the gaps 430 for prevent the grounding bar 40 passing out of the housing 10. The ribs 1280 and the gaps 430 combination the T-shaped grounding bar 40 and receiving trough 128 serve as downward stops for ground bar 40 assembly to the housing 10. The inner conductors 301 of the cables 30 are connected to the contacts 20 and the outer conductors 302 of the cables are respectively received in the hollows 420 of the grounding bar 40 and electrically connected to the grounding bar 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a housing comprising a main portion defining a connecting direction and a mating portion defining a mating direction, the connecting direction being perpendicular to the mating direction;

a plurality of contacts receiving in the housing;

a plurality of cables each comprising an inner conductor connected to the contacts and an outer conductor;

a grounding bar connected to all the outer conductors of the cables; wherein the grounding bar defines a long side extending along a direction perpendicular to the connecting direction and a short side extending along a direction parallel to the mating direction, and the housing comprises a receiving trough to receive the grounding bar, the receiving trough comprises a plurality of ribs located on the bottom thereof, the grounding bar comprises a plurality of gaps located on the bottom thereof and corresponding to the ribs of the receiving trough.

2. The cable assembly as claimed in claim 1, wherein the grounding bar is substantially of T-shape configuration.

3. The cable assembly as claimed in claim 1, wherein the grounding bar comprises a dentate top portion with a plurality of hollows, said outer conductors of the cables are respectively partly received in the hollows.

4. The cable assembly as claimed in claim 1, wherein said receiving trough is substantially of T-shape configuration.

5. The cable assembly as claimed in claim 1, wherein said main portion of the housing further comprises connecting portion defining a plurality of holes receiving the contacts and a plurality of receiving slots corresponding to the holes, and a supporting portion with a plurality of receiving grooves, the receiving slots and the receiving grooves extends along the connecting direction.

6. The cable assembly as claimed in claim 5, wherein the receiving trough is located between the receiving slots and the supporting portion.

7. The cable assembly as claimed in claim 6, wherein the mating portion of the housing comprises a rectangular mating groove, the contacts are arranged on two side walls of the mating groove.

8. The cable assembly as claimed in claim 7, wherein the grounding bar comprises a dentate top portion with a plurality of hollows, said outer conductors of the cables are respectively partly received in the hollows.

9. The cable assembly as claimed in claim 8, wherein said receiving trough is substantially of T-shape configuration.

10. A cable assembly, comprising:

a housing comprising a main portion and a mating portion;

a plurality of contacts receiving in the housing;

a plurality of cables each comprising an inner conductor connected to the contacts and an outer conductor;

a grounding bar received in the housing and being substantially of vertical T-shape configuration; wherein the housing comprises a receiving trough to receive the grounding bar and said receiving trough comprises a plurality of ribs located on the bottom thereof, the grounding bar comprises a plurality of gaps located on the bottom thereof and corresponding to the ribs of the receiving trough.

11. The cable assembly as claimed in claim 10, wherein the mating portion of the housing defines a mating direction, and the main portion defines a connecting direction, said mating direction is perpendicular to the connecting direction.

12. The cable assembly as claimed in claim 11, wherein the grounding bar defines a long side extending along a direction perpendicular to the connecting direction and a short side extending along a direction parallel to the mating direction, and the housing comprises a receiving trough receiving the grounding bar.

13. The cable assembly as claimed in claim 11, wherein said main portion of the housing further comprises connecting portion defining a plurality of holes receiving the contacts and a plurality of receiving slots corresponding to the holes, and a supporting portion with a plurality of receiving grooves, the receiving slots and the receiving grooves extends along the connecting direction.

14. An electrical cable connector assembly comprising:

an insulative housing;

a plurality of contacts disposed in the housing, each of said contacts defining a mating section and a soldering section;

a plurality of coaxial wires each including an inner conductor and an outer conductor;

the inner conductors being soldered to the solder sections of the corresponding contacts;

a conductive grounding bar defining a plurality of hollows compliantly receiving the outer conductors of the wires for both electrical and mechanical connection therebetween, respectively, and said grounding bar being retained in position within the housing; wherein said coaxial wires commonly define a plane with two opposite sides, and the grounding bar and the contacts are both located by one same side of the plane.

15. The electrical cable connector assembly as claimed in claim 14, wherein said housing defining a receiving trough communicative to an exterior in a direction to receive said grounding bar therein.

16. The electrical cable connector assembly as claimed in claim 15, wherein said hollows are communicative to the interior in said direction.

17. The electrical cable connector assembly as claimed in claim 14, wherein said grounding bar is of a plate type defining a thickness direction same with an axial direction of the corresponding wires.

18. The electrical cable connector assembly as claimed in claim 14, wherein no solder joints are formed between the grounding bar and the outer conductors, and mechanical connection between the outer conductors and the grounding bar is achieved by snugly clamping of the outer conductors within the corresponding hollows, respectively.

19. The electrical cable connector assembly as claimed in claim 14, wherein said grounding bar is fully embedded within the housing.

* * * * *